United States Patent [19]

Eberl

[11] Patent Number: 4,825,487

[45] Date of Patent: May 2, 1989

[54] APPARATUS FOR THE POSITIONING OF PEOPLE, ESPECIALLY NEW-BORN BABIES, IN A LYING POSITION

[76] Inventor: Tertulin Eberl, Nonnenwaldstrasse 25, 8122 Penzberg, Fed. Rep. of Germany

[21] Appl. No.: 62,347

[22] Filed: Jun. 11, 1987

Related U.S. Application Data

[63] Continuation of Ser. No. 818,457, Jan. 13, 1986, abandoned.

[30] Foreign Application Priority Data

Jan. 22, 1985 [DE] Fed. Rep. of Germany ..... 3502003

[51] Int. Cl.[4] ..... A47C 27/00

[52] U.S. Cl. ..... 5/464; 5/431; 5/436; 5/448

[58] Field of Search ..... 5/431, 434, 436, 464, 5/465, 481, 451, 450; 297/DIG. 1

[56] References Cited

U.S. PATENT DOCUMENTS

| | | | |
|---|---|---|---|
| D. 187,638 | 4/1960 | Kelly | 5/449 |
| 2,876,459 | 3/1959 | Ackerson | 5/431 |
| 2,974,322 | 3/1961 | Norris | 5/481 |
| 3,118,153 | 1/1964 | Hood | 297/DIG. 1 |
| 3,161,436 | 12/1964 | Hood | 297/DIG. 1 |
| 3,246,443 | 4/1966 | Slemmons | 5/481 |
| 3,266,066 | 8/1966 | Bereday | 297/DIG. 1 |
| 3,319,272 | 5/1967 | Eller | 5/436 |
| 3,689,948 | 9/1972 | Graves et al. | 5/449 |
| 3,721,232 | 3/1973 | Trenchard | 128/24 R |
| 3,761,975 | 10/1973 | Personett | 5/449 |
| 3,803,646 | 4/1974 | Newerowski | 5/93 R |
| 3,810,265 | 5/1974 | McGrew | 5/451 |
| 3,858,379 | 1/1975 | Graves et al. | 5/450 |
| 3,885,257 | 5/1975 | Rogers | 5/464 |
| 3,967,333 | 7/1976 | Boyd | 5/317 R |
| 4,234,977 | 11/1980 | Snow | 5/419 |
| 4,281,425 | 8/1981 | Jacobs | 5/455 |
| 4,434,513 | 3/1984 | Welch | 5/425 |
| 4,517,692 | 5/1985 | Vogel | 5/481 |
| 4,520,517 | 6/1985 | Ahlm | 5/481 |
| 4,541,885 | 9/1985 | Caudill, Jr. | 5/481 |

FOREIGN PATENT DOCUMENTS

| | | | |
|---|---|---|---|
| 2318964 | 10/1974 | Fed. Rep. of Germany | 5/449 |
| 3025939 | 1/1982 | Fed. Rep. of Germany | 5/431 |
| 506137 | 10/1951 | France | 5/481 |
| 1151790 | 2/1958 | France | 5/434 |
| 1422532 | 11/1965 | France | 5/481 |
| 1466464 | 1/1967 | France | 5/93 R |
| 2526649 | 11/1983 | France | 5/465 |
| 225934 | 4/1969 | Sweden | 5/434 |
| 1031814 | 6/1966 | United Kingdom | 5/436 |
| 2107580 | 5/1983 | United Kingdom | 5/481 |

*Primary Examiner*—Michael Safavi
*Attorney, Agent, or Firm*—Jordan and Hamburg

[57] ABSTRACT

The invention refers to an apparatus for the positioning of people, in particular new-born babies, especially during transport, in a lying position. It consists of an elastic deformable mat (10) which is provided with a filling material (17) made of addition-cross-linked two-component silicone rubber or a non-cross-linked or low-cross-linked polyurethane which is provided with an external plasticizing agent and which is enclosed by an outer cover (18) made of a polyurethane sheet or a silicone layer. The mat (10) preferably has a tub-like configured head part (12), in which a border (13) extends beyond the surface (14) on the top side of the head part. In the head part there can be provided a depression (15) for the back of the head and a bulge (16) for the back of the neck of a new-born baby. The pre-formed mat can also be arranged in a form-maintaining depression of a block made of soft integral foam or coated soft foam. The mat can have a two-layered construction, whereby one of the layers can be harder than the other. The two layers can be separated from each other by means of a sheet which is fixedly connected to the outer cover along its border.

28 Claims, 2 Drawing Sheets

APPARATUS FOR THE POSITIONING OF PEOPLE, ESPECIALLY NEW-BORN BABIES, IN A LYING POSITION

This application is a continuation of application Ser. No. 818,457 abandoned, filed Jan. 13, 1986.

BACKGROUND OF THE INVENTION

The invention relates to an apparatus for the positioning of people, in particular new-born babies, in a lying position, which includes an elastically deformable mat provided with a filling material which is enclosed by an outer covering.

Such an apparatus is used, for example for the positioning of new-born babies, especially premature babies, in incubators during transport in ambulances or hospital cars. Heretofore, water was used as a filling material, the water being introduced through an opening which could be closed by a stopper in the plastic sheeting out of which the outer cover is made.

Such an apparatus has a number of disadvantages. The outer cover has a low elasticity. Because of the incompressibility of the water and the low elasticity of the outer cover, the mat becomes a relatively hard support which transmits shocks of the vehicle caused by the transport almost undampened to the head and the body of the new-born baby, whereby there results a considerable risk of injury to the new-born baby. This is further aggravated in that the mat requires a surrounding free space, so that if the mat is pressed in at one location, it can correspondingly bulge out at another location. If there is no free space, as in an incubator, because the mat is bordered on several sides by fixed walls, then the mat in the incubator becomes even harder than it inherently would be due to the low plasticity of the outer cover. However, this known apparatus also has the disadvantage that it provides little support for the new-born baby against displacement on the mat caused by external accelerative forces, such as for example braking forces, and provides no protection against hitting the head against the walls of the incubator due to such displacement. Especially for new-born babies, there exists a considerable danger of head injury in case of coming into contact with hard objects. Furthermore, there is the disadvantage that the mat has a relatively high heat-conductive capability, so that after a relatively short period of the new-born baby's being on the mat, there is the danger of causing a subnormal body temperature. Not lastly, there is also the disadvantage that leakages in the outer cover or at the filling opening can occur, which leads to inoperativeness of the apparatus. Furthermore, if the water leaks out, the health of the new-born baby and/or the operativeness of the incubator can be impaired.

SUMMARY OF THE INVENTION

An object of the invention is to provide an apparatus of this general type which makes possible a safe, soft and heat-favorable positioning of a person who is placed thereon in a lying position, whereby suitable elastic deformability of the mat is assured without permanent deformation.

The object of the invention is attained by providing that the filling material is made of an addition-cross-linking two-component silicone rubber material or non-cross-linked or low-cross-linked polyurethane containing an external plasticizer and that the outer cover is made of a polyurethane sheet or of a silicone layer.

The apparatus according to the invention makes it possible to place a person who has to be transported in a soft, elastic and extensively displacement-resistant position, whereby the low capability of heat-conductivity of the material composition of the mat according to the invention prevents the mat from perceivably reducing the person's body temperature. The apparatus according to the invention is especially suited as a support for new-born babies during transport in incubators, because it protects the new-born against injuries and unhealthy reduction of body temperature. Furthermore, the apparatus according to the invention is easy to handle because it is made in one piece. In addition, it has the advantage that the filling material does not come out of the outer cover, even if there is a hole or a tear in the sheet.

According to another embodiment of the invention, the mat has a tub-shaped head part. The person to be transported is positioned on the mat such that his head lies in the tub-shaped head part of the mat. Thereby the head is prevented from coming into contact with the wall of the incubator in case of possible displacement of the new-born due to great accelerative forces, such as occur during braking, negotiating curves, or if the ambulance or the hospital car is involved in an accident.

A safe positioning of the person on the mat of the apparatus according to the invention is furthered according to another embodiment of the invention if the head part of the mat is provided with a depression for the back of the head and a bulge for the back of the neck.

Unavoidable shocks of the vehicle or unavoidable jolts which act upon the vehicle are not transmitted to the especially vulnerable head of the new-born if, according to another embodiment of the invention, the head part of the mat is thicker than the flat-shaped foot part of the mat.

In order to increase the form stability of the mat and to reduce the material requirement for the filling material, according to another embodiment of the invention, the mat can be arranged in a depression of a block made of soft-integral foam or coated soft foam.

The terms soft-integral foam and soft foam are to be understood to mean an artificially produced, soft elastic foamy plastic of cellular structure. Preferably the soft-integral foam or soft foam for the apparatus of the invention is made of polyurethane. The block made of coated soft foam is manufactured according to a conventional method in that the foamable mixture is introduced into a mold which is lined with a plastic sheet. There is thereby obtained a finished combination of a plastic cover layer and a soft elastic foamy plastic. However, in the conventionally known production of the block made of soft-integral foam around a cellular core, there is formed a closed covering layer made of the same material.

The lying characteristics of the apparatus according to the invention can be further improved, if the filling material of the mat is made of at least two layers which are of different hardness and which can be separated from each other by a plastic sheet, which is fixedly connected to the outer covering. Technologically producing such an apparatus is especially advantageous, in that the outer cover consists of two polyurethane sheets which are heat-sealed or fused together along their borders. Preferably, in case of a filling body consisting of several layers, the separating sheet consists also of a polyurethane sheet which is heat-sealed or fused along its border to the borders of the sheets which form the outer cover.

The thickness of the sheet or sheets for the outer cover, as well as that of the separating sheet, in case it is used, is in the range of 0.01 and 0.08 mm. Preferably, the sheet on the top side of the mat and the separating sheet each have a thickness of 0.025 mm, whereas the sheet on the bottom side of the mat preferably has a thickness of 0.05 mm. According to the invention, the selected thickness of the sheet or sheets considerably contributes to the excellent lying characteristics of the apparatus according to the invention.

The apparatus according to the invention is excellently suited as permanent bedding for premature babies in incubators when no transport is intended. Up to now, premature babies have been positioned in incubators on fabric sheets or the like. In tests performed in hospitals, it has surprisingly been shown that children in incubators are considerably more comfortable if they lay on a mat according to the invention. Presumably, this effect is due to the fact that the child experiences a similar lying sensation on the mat according to the invention as in the mother's body. Presumably, this lying sensation is due to the fact that the material which is used as filling material has approximately the same consistency as human tissue.

A further advantage of the apparatus according to the invention is that all utilized materials are physiologically entirely harmless and biocompatible.

Even if the apparatus according to the invention is primarily suited and intended for new-born babies, in particular premature babies, it is not limited to this application, but if necessary, can also accordingly be used as bedding for bed-ridden patients in order to prevent and to treat bedsores, and as a support for people who have been injured in accidents or the like who have to be positioned in a soft, elastic, yet stable way.

Various embodiments of the invention are illustrated in the drawings and will be described in greater detail hereinafter. The drawings show the following:

DESCRIPTION OF THE PREFERRED EMBODIMENTS

Figure 1:
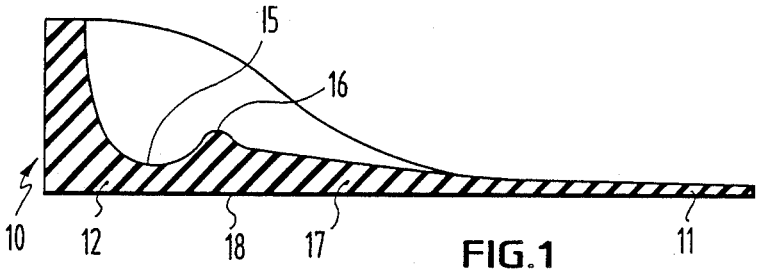
FIG. 1 is a longitudinal cross-sectional view through an apparatus according to a first embodiment of the invention taken along the line I—I in FIG. 2.
Figure 2:
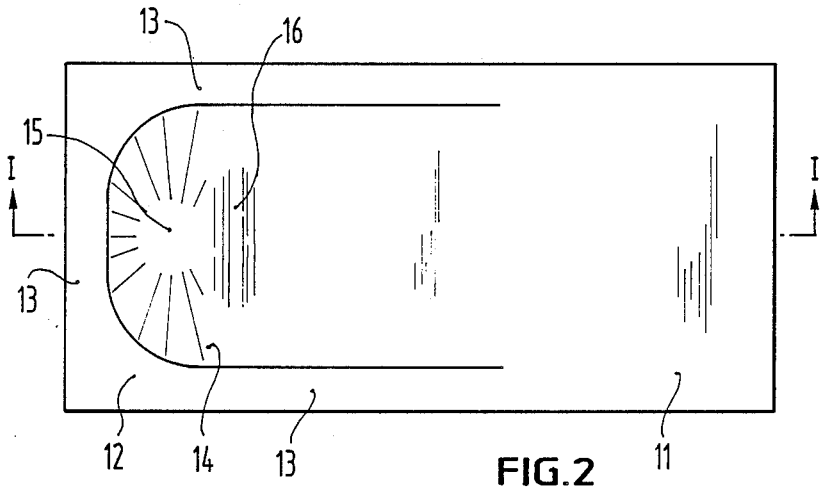
FIG. 2 is a plan view of the apparatus shown in FIG. 1.

As can be seen in FIGS. 1 and 2, the apparatus according to the first embodiment of the invention consists of an elastically deformable mat 10 which, when viewed from the top, is essentially of a rectangular shape and is dimensioned so that it fits into an incubator. The mat 10 consists of a flat-like foot part 11 and a tub-like head part 12.

The tub-like configuration is produced such that on the two longitudinal sides of the head part 12 and on the end of the head part 12, which in FIGS. 1 and 2 is shown at the left side, there is formed a rim 13, which extends beyond an adjacent surface 14 at the inner upper side of the head part. The rim 13 extends downward slantingly at the sides of the head part, as can be seen in FIG. 1, and gradually makes a transition into the foot part 11. The inside surface 14 of the head part 12 is provided with a depression 15 which is approximately adapted to the shape of the back of the head of a new-born baby. A bulge 16 which joins the depression 15 on the inside surface 14 of the head part 12 is adapted to the shape of the back of the neck of a new-born. Due to the depression 15 and the bulge 16, the new-born baby can be relatively stably positioned on the mat 10, whereby the high-elevated rim 13 at the head part 12 of the mat 10 provides additional protection for the head against making contact with the incubator's hard wall which surrounds the mat 10 when it is arranged in the incubator. In the cross-sectional view, the area of the head part 12 which is provided with the surface 14 is thicker than the foot part 11, so that shocks and shaking induced by the vehicle to the mat 10 are strongly dampened such that they cannot be transmitted to the head of the new-born baby.

The mat 10 of the apparatus according to the invention is made in one piece and consists of an elastically deformable filling material 17 which is covered by an elastic outer cover 18. The filling material consists either of a resilient, soft, addition-cross-linking two-component silicone rubber mass of a gelatinous, sticky consistency or of a non-cross-linked or low-cross-linked polyurethane containing an external plasticizer.

The utilized silicone rubber mass according to the invention is of the RTV (Room-Temperature-Vulcanizing)-type and is obtained from linear organopolysiloxanes containing alkenyl bonds and Si-H bonds in the presence of precious metal catalysts, such as for example platinum and platinum compounds, by means of vulcanization at elevated temperature, whereby, depending on the kind and number of the functional groups in the organopolysiloxanes containing the Si-H bonds, there result either pure or organosiloxane resin-containing elastomers. Even though the vulcanization of the linear organopolysiloxanes can take place in the presence of precious metal catalysts at room temperature, the vulcanization at slightly increased temperature is especially advantageous. The vulcanization time of the catalyzed mixture is from 1 to 6 hours at 40 to 120 degrees C.

The addition-cross-linking silicone rubber mass utilized according to the invention is physiologically harmless and biocompatible. It can be easily pressed in and, based upon its elastic behavior, resumes its original shape without springing back resiliently like rubber and without permanent elastic deformation.

As an enclosing outer cover, there is used a polyurethane sheet which has a sufficient elasticity and strength (elongation 600%). It has a thickness of 0.025 mm.

The apparatus according to the invention can be produced in that a non-cross-linked silicone rubber mass is cross-linked in a two-part mold having a cavity corresponding to the outline of the mat by adding heat while the mass is located between two polyurethane sheets which are clamped at their edges between the mold shapes, and the sheets are joined to each other along the border of the mat by means of heat-sealing, such as for example fusing, whereafter the mat is taken out of the mold. Individually, the production method can proceed in that two flat-lying polyurethane sheets, which form the mat's outer cover are fused together along what is to be the mat's border up to a filling opening and are fixed in the area of the fused border on the lower mold part. The lower mold part is then closed by the upper mold part and the non cross-linked silicone rubber mass is injected under pressure through the filling opening of the fusing border between the plastic sheets until it presses the plastic sheets against the walls of the cavity of the mold, whereafter the mass is cross-linked in the mold and subsequently the filling opening is fused.

When instead of silicone rubber there is used a polyurethane containing an external plasticizing agent, it is processed in a corresponding way.

The polyurethane for the filling material which is used according to the invention is a conversion product from an aromatic diisocyanate and a long-chained polyether with a hydroxyl equivalent between 2 and 3. The aromatic diisocyanates may be the usual ones used in polyurethane technology, in particular diphenylmethanediisocyanate. The long-chained polyether can, for example, have a molecular weight in the range of 180 to 8000, preferably 500 to 1000. Polypropyleneglycol of a molecular weight in the mentioned ranges has proved to be especially advantageous.

In order to obtain a suitable consistency of the mat, preferably greater quantities of the external plasticizing agent are used, such as for example at least 30 weight percent, and in particular at least 50 weight percent. The proportion of the external plasticizing agent can be up to 90 weight percent. The proportions of the external plasticizing agent are considered in relation to the total mass, that is, in relation to the polyurethane and the external plasticizing agent.

As plasticizing agents, all conventional external plasticizing agents which are known in plastics technology may be used, such as for example dibutylphthalate and dioctylphthalate. Especially suited as external plasticizing agents, however, have proved to be long-chained polyethers of such kind as are also used for the production of the polyurethane component of the mat. It is especially advantageous if the polyether component of the polyurethane and the plasticizing agent of the mat are identical. In such a case, during the production of the polyurethane, it is only necessary to utilize a corresponding excess amount of long-chained polyether.

Although a polyurethane sheet is preferred for the outer cover, it can also consist of a silicone layer.

A mat with a silicone outer cover can be produced in that on the inside surface of the mold, there is produced a silicone layer which is relatively highly cross-linked, but which still has the required elasticity. Highly cross-linked silicone is required so that the outer layer is not sticky. Further processing then takes place in that the mass is introduced into the closed mold, so that the mass polycondenses by heating into a softened polyurethane.

Cold-setting starting masses can also be used if corresponding reactive catalysts are used.

When two polyurethane sheets which are fused together along their borders are used for the outer cover, the upper sheet has a thickness of 0.025 mm. and the lower sheet has a thickness of 0.05 mm.

An apparatus according to a second embodiment of the invention is shown in FIGS. 3 to 6. It deviates only slightly from the apparatus according to the first embodiment of the invention. In the description below are pointed out only the differences which the apparatus according to the second embodiment has in relation to the apparatus according to the first embodiment. For the parts of the apparatus of the second embodiment which are also used in the apparatus according to the first embodiment, the same reference numerals are used in FIGS. 3 to 6 as in FIGS. 1 and 2.

The mat 10 of the apparatus according to the second embodiment of the invention is configured entirely tub-shaped, whereby the inwardly extending inclined border 13, which becomes thicker towards the bottom, is higher at the head part 12 than at the foot part 11, and the head part 12 is narrower than the foot part 11. In the head part 12 there is a depression, into which just fits the head, which is schematically indicated by a dotted line, of a baby which is not illustrated. At the bottom, the mat 10 has essentially the same thickness throughout. The head part as well as the foot part are narrower and shorter than in the mat of the apparatus according to the first embodiment of the invention, and it is disposed to lie loosely in a depression of a block 19 made of a coated soft foam made of polyurethane of which the width and the length are of such dimensions that it just fits into an incubator. The depression of the block 19 is of such shape that the mat 10 just fits into it like in a mold whereby the border of the depression of the block 19 lies next to the border of the mat 10. Because the block 19 is form-stable and inherently stable, the mat 10 is only conditionally form -stable, and it is the block 19 which gives the mat 10 the required support so that it maintains its specified tub-shape. It can be recognized without problems that the mat 10 of the apparatus according to the second embodiment requires substantially less material than the mat of the apparatus according to the first embodiment. Furthermore, the apparatus according to the second embodiment is as a whole more form-stable and inherently stable than the apparatus according to the first embodiment.

A bulge is not provided in the mat 10 of the apparatus according to the second embodiment. If desired, it could subsequently be produced in a simple way such that between the mat 10 and the block 19 there is placed at a suitable location a shaped part, such as for example a fabric sheet, which would cause the mat to bulge out in a projection. The materials of the mat according to the second embodiment are the same as those used in the apparatus according to the first embodiment. The production method is also the same.

Figure 7:
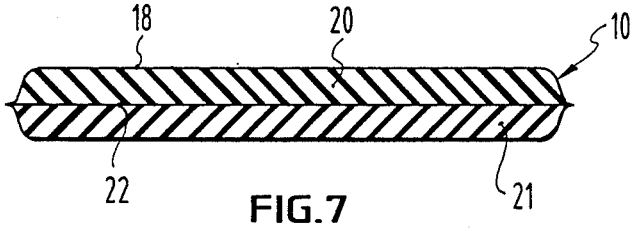
FIG. 7 is a cross-sectional view of an apparatus according to a third embodiment of the invention.
Figure 3:
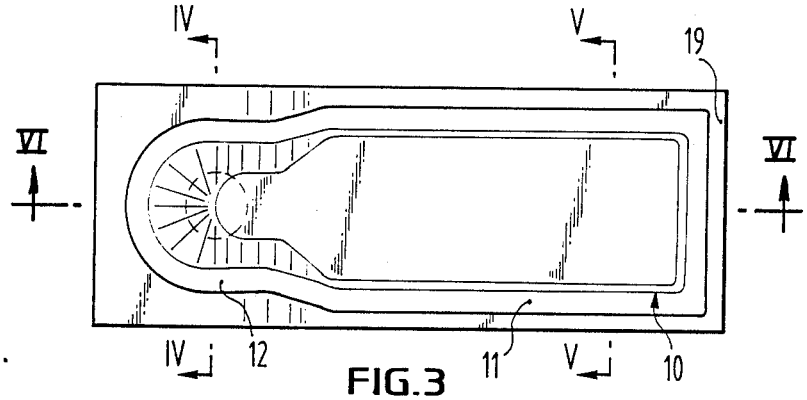
FIG. 3 is a plan view of an apparatus according to a second embodiment of the invention.
Figure 4:
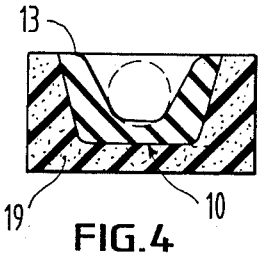
FIG. 4 is a cross-sectional view of the apparatus shown in FIG. 3 taken along the line IV—IV in FIG. 3.
Figure 5:
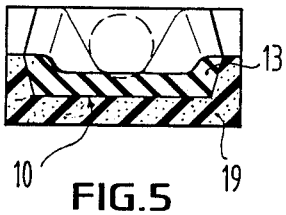
FIG. 5 is a cross-sectional view of the apparatus shown in FIG. 3 taken along the line V—V in FIG. 3.
Figure 6:
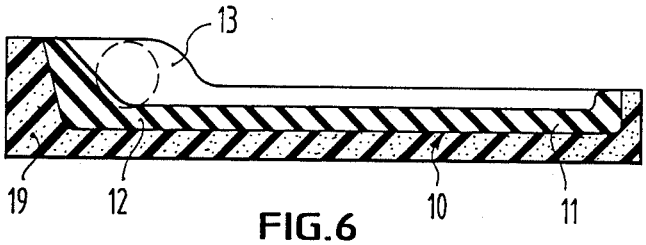
FIG. 6 is a longitudinal sectional view of the apparatus shown in FIG. 3 taken along the line VI—VI in FIG. 3.

An apparatus according to a third embodiment of the invention is shown in FIG. 7, whereby the same reference numerals'have been used for the corresponding parts as in FIGS. 1 to 6. It also consists of a mat 10, however, in contrast to the mats of the two other embodiments, it has a flat top side and a flat bottom. It is intended as permanent bedding for new-born babies, in particular premature babies in incubators when no transport of the child with the incubator is required. The essential difference between the mat 10 of the apparatus according to the third embodiment compared to the mats of the above described apparatus consists in that it has a two-layered construction, whereby the upper layer 20, i.e., the layer which, when used in the designated way, is closer to the person to be positioned on it, is softer than the lower layer 21. Both layers 20 and 21 are made like the filling material of the above-described mats of an addition-cross-linking two-component silicone rubber mass or of a non-cross-linked or low cross-linked polyurethane containing an external plasticizing agent. The filling body of the mat 10 consisting of the two layers 20 and 21 is enclosed by an outer cover 18 made of two polyurethane sheets which are heat-sealed or fused together along their borders. The two layers 20 and 21 are separated by another polyurethane sheet 22 which is heat-sealed or fused together along its border to the borders of the polyurethane sheets which form the outer cover 18. The sheet of the outer cover 18 which forms the top side of the mat 10 has the same thickness as the separating sheet 22. The thickness of these two sheets is 0.025 mm. The sheet of the outer cover 18 which forms the bottom side of the mat 10, however, has a thickness of 0.05 mm. The external dimensions of the mat 10 are kept to such dimensions that they just fit into an incubator. The two-layered construction with layers of various hardness has the advantage that the upper layer 20 can be kept very soft, so that it provides an extremely comfortable lying without concern that a stress, which is applied and concentrated over a small area, will depress the mat down so that it possibly reaches a hard bottom of the incubator. Because, as a whole, the mat 10 is still soft and elastically deformable despite the somewhat harder layer 21, by placing form parts, such as sheets, under the mat, it is possible to give it a suitable shape corresponding to the needs of the individual child. The mat 10 can be produced according to the production of the above-described mats, whereby instead of only one filling opening, there are provided two filling openings. However, it is also possible to provide only one joint filling opening at a suitable location of the sheets.

The apparatus according to the third embodiment can be modified in that between the two variously hard filling body layers 20 and 21 there is not provided any separating sheet. In the production of such an apparatus it is possible to proceed so that into one of the lined mold halves of which the lining later forms the sheet of the outer cover, the still not cross-linked material for one of the layers of the filling bodies is introduced, that only after cross-linking of this material the still not cross-linked material for the other layer of the filling body is introduced over the first layer of the filling body, that subsequently the other sheet is placed over the other layer of the body of the filling material and the two mold halves are closed, whereafter the cross-linking of the other layer of the filling material takes place. The two sheets are then heat-sealed or fused together along their borders which are clamped on top of each other between the two mold halves.

What I claim is:

1. Apparatus for supporting people, particularly new born babies, in a lying position, comprising an elastically deformable mat, said mat having an outer cover and a non-cellular gel-like filling material enclosed within said outer cover, said filling material being selected from a group consisting of an addition-cross-linked two-component silicone rubber, a non-cross-linked polyurethane containing an external plasticizing agent and a low-cross-linked polyurethane containing an external plasticizing agent and having a sticky consistency, said outer cover being selected from a group consisting of a polyurethane sheet and a silicone layer, and sticking to the filling material by contacting said outer cover with said filling material while said filling material is in a liquid state and thereafter allowing said filling material to cure within said outer cover, whereby the sticky filling material sticks to said cover.

2. Apparatus according to claim 1, wherein said mat has a generally rectangular configuration in plan view with a head portion at one end and a foot portion at a second end, said head portion having a tub-like configuration for accommodating a back and sides of an upper part of a person's body.

3. Apparatus according to claim 2, wherein said head portion has a head section for accommodating a head of a person lying on the mat, said head section having a concave configuration corresponding to the configuration of a back part of a person's head.

4. Apparatus according to claim 3, wherein said head portion has a neck section for supporting a rear part of a person's neck, said neck section being juxtaposed to said head section, said neck section having a convex configuration.

5. Apparatus according to claim 2, wherein said foot portion is generally flat, said tub-like configuration of said head portion having a bottom, said bottom being thicker than said foot portion.

6. Apparatus according to claim 1, wherein said outer cover comprises two polyurethane sheets having borders, and sealing means sealing the borders of said two polyurethane sheets.

7. Apparatus according to claim 6, wherein one of said polyurethane sheets is a top sheet which is contacted by a person lying on the mat and the other polyurethane sheet is a bottom sheet, said top sheet having a thickness of 0.025 mm, said bottom sheet having a thickness of 0.06 mm.

8. Apparatus according to claim 1 further comprising an outer block, said outer block being made of a plastic foam material, said outer block having a depressed portion, said mat being disposed within said depressed portion such that said outer block supports said mat.

9. Apparatus according to claim 8, wherein said outer block is made of a material selected from a group consisting of soft integral foam and coated soft foam.

10. Apparatus according to claim 8, wherein said outer block is a polyurethane soft foam.

11. Apparatus according to claim 8, wherein said depressed portion in said outer block is defined by two upright side walls and two upright end walls and said mat further comprises sides, said side walls and said end walls engaging the sides of said mat to snugly accommodate said mat in said depressed portion.

12. Apparatus according to claim 11, wherein said upright side walls and one of said upright end walls slope upwardly and outwardly.

13. Apparatus according to claim 8, wherein said mat has a bottom portion and two side walls extending with a slope upwardly and outwardly from said bottom portion, said bottom portion having a constant thickness.

14. Apparatus according to claim 8, wherein said mat has a bottom portion, and a generally upwardly extending wall extending upwardly about a periphery of said mat, said mat having a head end and a foot end, the upwardly extending wall at said head end extending upwardly to a greater height than the upwardly extending wall at said foot end, said upwardly extending wall at said head end having inner and outer surfaces, said inner and outer surfaces extending with a slope upwardly and outwardly.

15. Apparatus according to claim 14, wherein said head end is narrower than said foot end when viewed from the top.

16. Apparatus according to claim 14, wherein said upwardly extending wall at said head end has a top and a bottom, said bottom being thicker than said top.

17. Apparatus according to claim 1, wherein said filling material comprises at least two layers, each of said layers of filling material having a different hardness.

18. Apparatus according to claim 17 further comprising a separating sheet of plastic material disposed between and separating said two layers of filling material, and connecting means connecting said separating sheet to said outer cover.

19. Apparatus according to claim 17, wherein said outer cover comprises two polyurethane sheets having borders, and sealing means sealing said two sheets together along said borders.

20. Apparatus according to claim 19 further comprising a separating sheet of polyurethane disposed between and separating said two layers of filling material, said separating sheet having borders, the borders of said separating sheet being sealed to the borders of said two polyurethane sheets of said outer cover by said sealing means.

21. Apparatus according to claim 18, wherein said separating sheet and said outer cover each have a thickness of from 0.01 to 0.08 mm.

22. Apparatus according to claim 21, wherein said outer cover includes a top sheet for contacting a person lying on the mat, said top sheet having a thickness of about 0.025 mm.

23. Apparatus according to claim 22, wherein said outer cover includes a bottom sheet, said bottom sheet having a thickness of 0.05 mm.

24. Apparatus according to claim 21, wherein said separating sheet has a thickness of 0.025 mm.

25. Apparatus according to claim 1, wherein said filling material is an addition-cross-linked two-component silicon rubber obtained from vulcanizing linear organopolysiloxanes containing alkenyl bonds and Si-H bonds in the presence of a precious metal catalyst.

26. Apparatus according to claim 1, wherein said filling material is a non-cross-linked or low-cross-linked polyurethane conversion produce of an aromatic diisocyanate and a long-chained polyether having a hydroxyl equivalent between 2 and 3 containing an external plasticizing agent.

27. Apparatus according to claim 26, wherein said aromatic diisocyanate is diphenylmethanediiosocyanate, said long-chained polyether is polypropyleneglycol and said external plasticizing agent is polypropyleneglycol.

28. Apparatus for supporting people, particularly new born babies, in a lying position, comprising an elastically deformable mat, said mat having an outer cover and a non-cellular gel-like filling material enclosed within said outer cover, said filling material having a sticking consistency when cured, said filling material being selected from the group consisting of an addition-cross-linked two-component silicone rubber, a non-cross-linked polyurethane containing an external plasticizing agent and a low-cross-linked polyurethane containing an external plasticizing agent, said outer cover being selected from the group consisting of a polyurethane sheet and silicone layer, said filling material being in contact with and sticking to said outer cover to thereby preclude shifting between the filling material and the outer cover, said sticking being obtained by contacting the outer cover with said filling material while the filling material is in a liquid state and allowing said filling material to cure within said outer cover.

* * * * *